US005199203A

United States Patent [19]

Jones

[11] Patent Number: 5,199,203

[45] Date of Patent: Apr. 6, 1993

[54] REUSABLE INDEXING TAB

[76] Inventor: Douglas W. Jones, 2807 Century Rd., Omaha, Nebr. 68123

[21] Appl. No.: 832,389

[22] Filed: Feb. 7, 1992

[51] Int. Cl.[5] ..... G09F 23/10

[52] U.S. Cl. ..... 40/641; 24/518; 40/658

[58] Field of Search ..... 40/641, 359, 360, 647, 40/658; 24/518, 517, 505, 521, 527

[56] References Cited

U.S. PATENT DOCUMENTS

| | | | |
|---|---|---|---|
| 104,661 | 6/1870 | Tanner | 24/517 |
| 287,349 | 10/1883 | Wales | 24/518 |
| 422,719 | 3/1890 | Capers | 24/517 |
| 681,313 | 8/1901 | Hammond | 24/517 |
| 790,329 | 5/1905 | Taylor | 24/521 |
| 1,147,147 | 7/1915 | Daniels | 24/517 |
| 2,062,436 | 12/1936 | Yawman | 129/16.8 |
| 2,597,426 | 5/1952 | Auckley | 40/23 |
| 3,058,186 | 10/1962 | Fanning, Jr. | 24/505 |
| 3,164,917 | 1/1965 | Harper | 40/23 |
| 3,735,515 | 5/1973 | Largert | 40/641 |
| 4,209,925 | 7/1980 | Brügmann | 40/359 |
| 4,660,855 | 4/1987 | Pagliaccio | 281/2 |

FOREIGN PATENT DOCUMENTS

| | | | |
|---|---|---|---|
| 50604 | 1/1890 | Fed. Rep. of Germany | 24/517 |
| 4268 | of 1893 | United Kingdom | 24/517 |

*Primary Examiner*—Kenneth J. Dorner
*Assistant Examiner*—Cassandra Hope
*Attorney, Agent, or Firm*—Zarley, McKee, Thomte, Voorhees & Sease

[57] ABSTRACT

A reusable indexing tab includes first and second interconnected wing portions which are pivotally connected along a hinge portion. Each wing portion includes a first panel which acts as a clamping jaw, a second panel which acts as an index tab, and a hinge portion connecting the first and second panels. In the preferred embodiment the wing portions are identical with one wing portion inverted to interconnect with the other wing portion. A clamping force is produced by forming a bend in each first panel generally midway between the upper and lower edges, with the upper edge bent rearwardly. The bias of the bends produces a clamping force between the first panels. A lock mechanism on the second panels will selectively maintain the wing portions in their clamped position. Preferably, a second bend is formed in each wing portion with each first panel bent rearwardly along the longitudinal connection with the associated hinge portion. The two bends in each first panel creates a strong clamping pressure when the wing portions are moved to the clamped position.

8 Claims, 4 Drawing Sheets

REUSABLE INDEXING TAB

TECHNICAL FIELD

The present invention relates generally to tabs for indexing sheets of paper, and more particularly to an improved reusable indexing tab which will releasably clamp on sheets of paper.

BACKGROUND OF THE INVENTION

While there are many paper clips, clamps, and index tabs known in the prior art, they still suffer several drawbacks. A common paper clip formed of bent plastic or metal wire, is typically formed in a single plane and attached to one or more sheets of paper by bending a tongue portion upwardly and inserting the paper between the tongue and the remainder of the clip. Such a clip relies on the resiliency of the metal to apply a force to bend the sheet of paper between the tongue and the remainder of the clip, to hold the clip to the paper. However, such a clip can easily wrinkle or damage the paper because of the force applied by the tongue on the paper. Thus, the paper can become slightly folded between the tongue portion and the base portion, thereby damaging the paper. Furthermore, the metal type clips typically have a projecting end which can easily catch and rip the paper when the paper is fully inserted in the clip.

Index tabs utilized in the prior art typically have a pair of adhesive backed legs which are permanently affixed to an index card or a file. The tab having a transparent portion which allows the insertion of an inscription sheet. While such tabs are easy to use in a filing system, they are impossible to use in a situation which requires a removable tab.

Other file tabs utilize a clamp type action to grip a piece of paper. While such tabs have the advantage of being removable from the sheet, they typically utilize a pair of gripping legs with edges bent towards one another to form a type grip. These edges grip the paper firmly but require that the gripping leg portions be manually separated before they may be attached to a card.

It is therefore a general object of the present invention to provide an improved removable index tab.

Another object of the present invention is to provide a removable index tab which may be attached and locked in engagement with a sheet of paper.

Still another object is to provide a removable index tab which will not damage the paper sheets to which it is attached.

These and other objects will be apparent to one skilled in the art.

SUMMARY OF THE INVENTION

The reusable indexing tab of the present invention includes first and second interconnected wing portions which are pivotally connected along a hinge portion. Each wing portion includes a first panel which acts as a clamping jaw, a second panel which acts as an index tab, and a hinge portion connecting the first and second panels. In the preferred embodiment the wing portions are identical with one wing portion inverted to interconnect with the other wing portion. A clamping force is produced by forming a bend in each first panel generally midway between the upper and lower edges, with the upper edge bent rearwardly. In this fashion, the bent upper edges of the first panels will be forced to a co-planar position with the unbent portions of the first panels when moved to a clamped position, against the bias of the bends. The bias of the bends thereby produces a clamping force between the first panels. A lock mechanism on the second panels will selectively maintain the wing portions in their clamped position. Preferably, a second bend is formed in each wing portion with each first panel bent rearwardly along the longitudinal connection with the associated hinge portion. The two bends in each first panel creates a strong clamping pressure when the wing portions are moved to the clamped position.

DESCRIPTION OF THE PREFERRED EMBODIMENT

Figure 1:
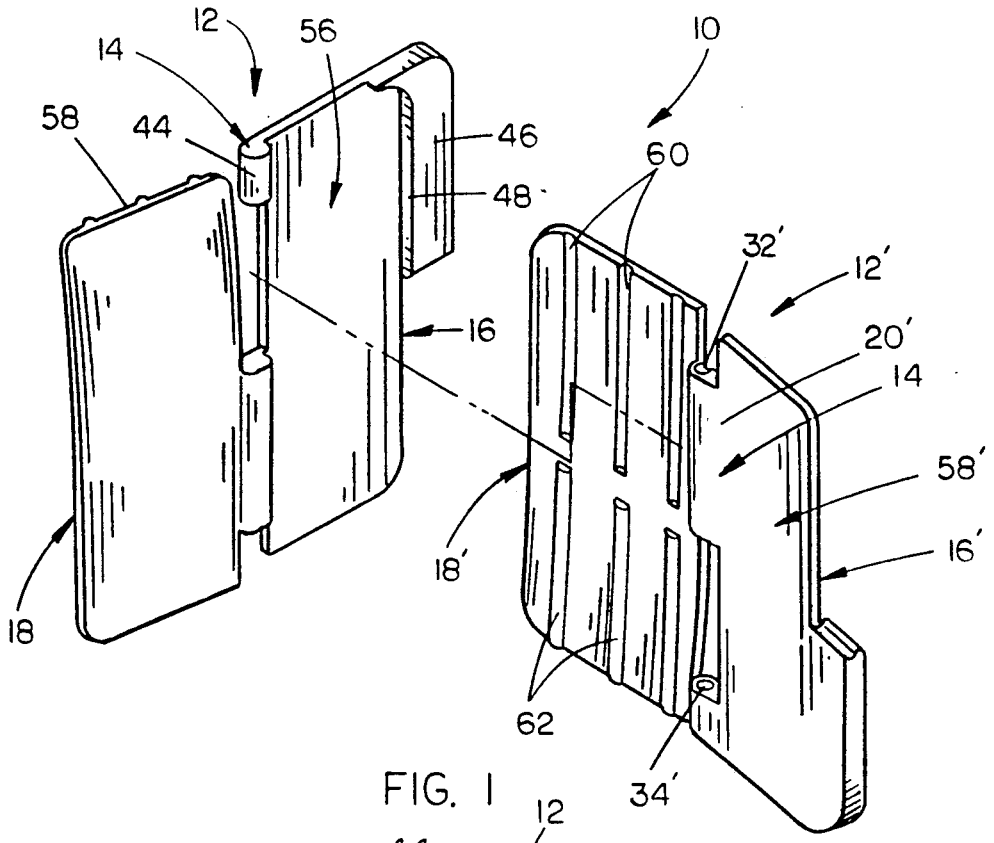
FIG. 1 is a perspective view of the present invention showing the two separate wing portions in exploded perspective.

Referring now to the drawings, in which similar or corresponding parts are identified with the same reference numeral, and more particularly to FIG. 1, the removal index tab of the present invention is designated generally at 10 and includes a pair of first and second wing portions 12 and 12' operably connected together at a hinge 14. In the preferred embodiment of the invention, wings 12 and 12' are identical. Therefore, only wing 12 will be described in detail herein, wing portion 12' having all of the same structure.

Figure 3:
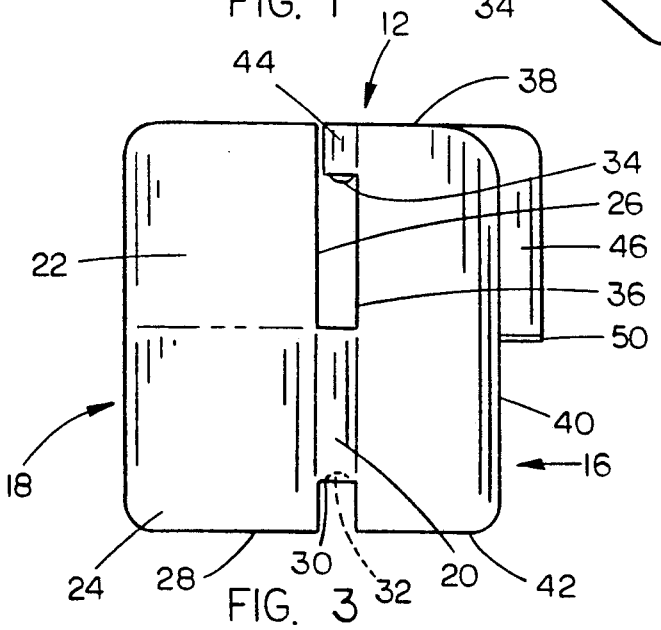
FIG. 3 is a front elevational view of the wing portion shown in FIG. 2.
Figure 4:
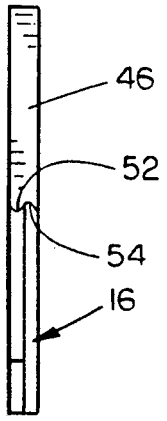
FIG. 4 is a side elevational view taken from the right side of the left wing portion of FIG. 1.
Figure 5:
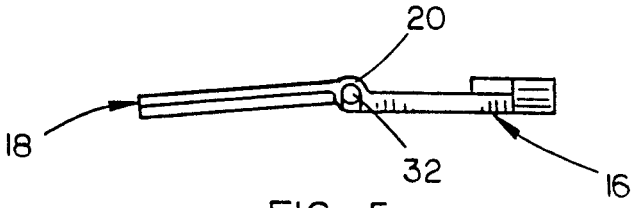
FIG. 5 is an end elevational view taken from the lower end of FIG. 3.

Referring now to FIGS. 2-5, wing 12 includes a generally planar first panel 16 connected to a generally planar second panel 18 at a generally cylindrical first hinge portion 20. As shown in FIG. 5, second panel 18 is bent slightly downwardly from hinge portion 20 so as to be at a slight angle with respect to first panel 16.

Figure 2:
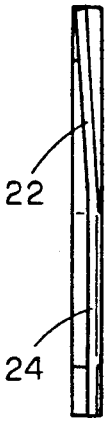
FIG. 2 is a side elevational view of one wing portion, taken from the left side of the left wing portion of FIG. 1.

Second panel 18 is also bent along a transverse line extending generally centrally across panel 18, as shown in FIG. 2, to form an upper leg 22 bent at an angle with respect to a lower leg portion 24, for a purpose to be described in more detail hereinbelow.

Figure 9:
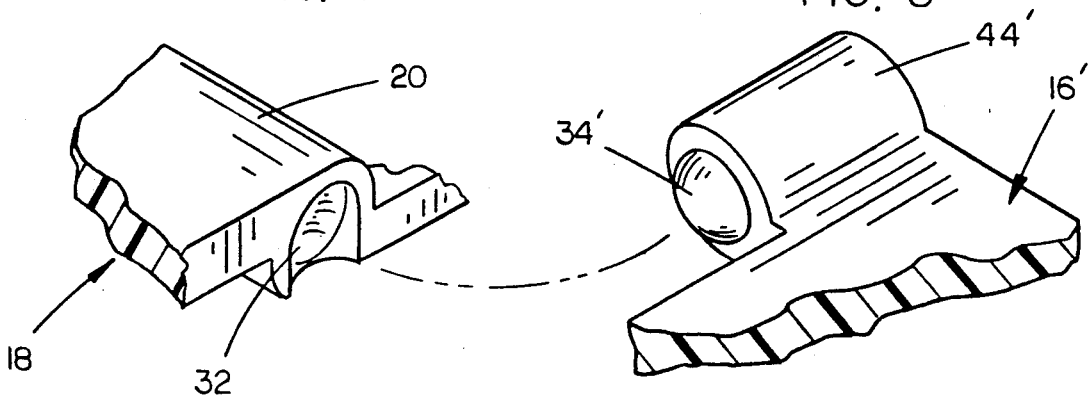
FIG. 9 is an enlarged exploded perspective of the hinged connection of the wing portions.

Hinge portion 20 extends downwardly from the midpoint of the inner edge 26 of second panel 18 and stops short of the lower edge 28, as shown in FIG. 3. The lower end 30 of hinge portion 20 has a depression 32 formed therein, to receive a projection 34' on a second wing 12', as shown in FIGS. 1 and 9.

Figure 6:
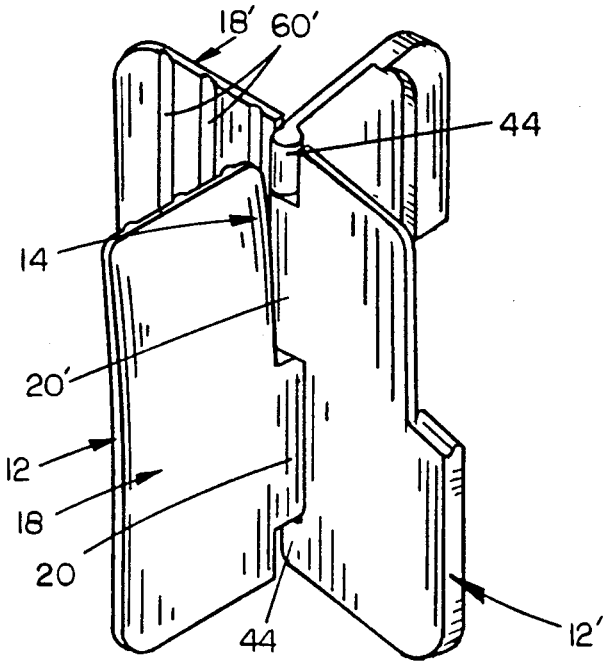
FIG. 6 is a perspective view of the present invention with both wing portions connected together for hinged movement.
Figure 7:
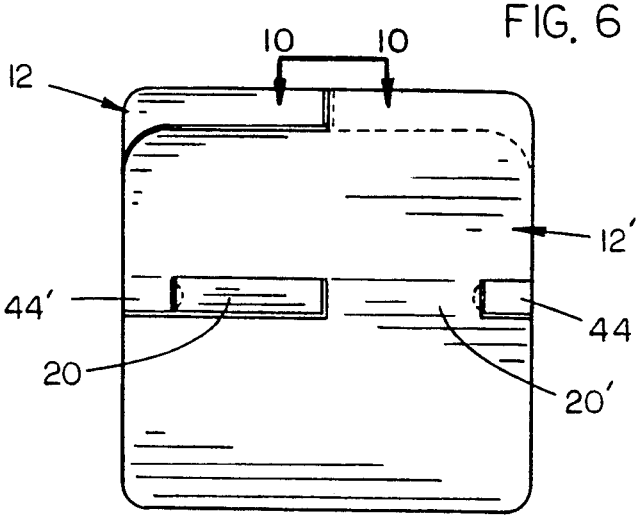
FIG. 7 is a front elevational view of the invention shown in FIG. 6 with the wing portions in an engaged position.
Figure 8:
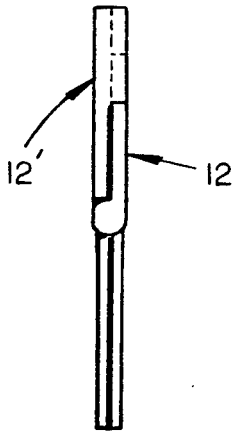
FIG. 8 is an end elevational view taken from the right side of FIG. 7.

First panel 16 includes an inner edge 36 parallel to the inner edge 26 of second panel 18, an upper edge 38 outer edge 40 and lower edge 42. The length of second panel 16 (between upper and lower edges 38 and 42) is equal to the length of second panel 18. A short second hinged portion 44 is aligned coaxial with first hinge portion 20 and is of a length corresponding to the distance between the lower end 30 of hinge portion 20 and lower edge 28. Second hinge portion 44 extends downwardly from the upper edge 38 of first panel 16 and has projection 34 extending downwardly therefrom, coaxial with hinge portions 20 and 44. In this way, a second wing 12' may be inverted such that first hinge portion 20' is located coaxial between hinge portions 20 and 44 on first wing 12 (as shown in FIGS. 6 and 7). Similarly, hinge portion 20 is located coaxial between hinge portions 20' and 44' of second wing 12'. Thus, hinge portions 20, 20', 44 and 44' form a pivotal hinge 14 about which wings 12 and 12' will pivot.

Although the interconnection of wings 12 and 12' is enhanced by the location of projections 34 and 34' in the respective depressions 32 and 32' of the corresponding hinge portions 20, 20', 44 and 44', it has been found that in a index tab 10 with a very close tolerances, these projections 34 and 34' are not necessary for the proper pivotal movement of wings 12 and 12'.

First panel 16 has a flange 46 projecting outwardly from outer edge 40 and extending from upper edge 38 to a point midway between upper and lower edges 38 and 42. Flange 46 is thicker than first panel 16 to form a shoulder 48 extending aligned with outer edge 40, as shown in FIG. 1. Shoulder 48 will retain a slip of paper or the like with identifying text written thereon between flange 46 and hinge 14.

Figure 10:
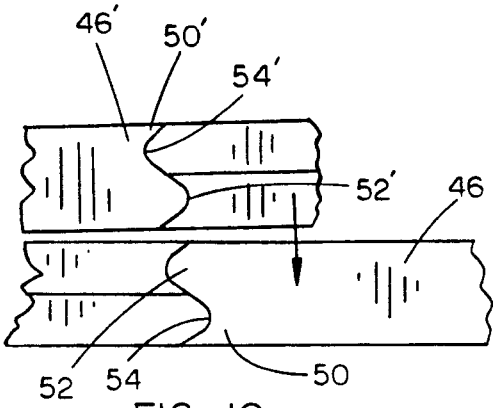
FIG. 10 is a side elevational view taken at lines 10-10 in FIG. 7.
Figure 11:
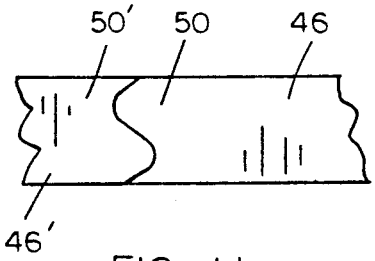
FIG. 11 is a side elevational view similar to FIG. 10, but with the wing portions moved to a locked position.

The lower end 50 of flange 46 has a downwardly projecting ridge 52 adjacent an upwardly projecting valley 54, as shown in FIGS. 4 and 10. Ridge and valley 52 and 54 on flange 46 are designed to cooperate with the reversed valley and ridge 54' and 52' on flange 46' of wing 12' as shown in FIGS. 10 and 11 to form a lock mechanism which will retain the wings 12 and 12' in a clamped position.

Referring now to FIGS. 1 and 6, wings 12 and 12' have a forward surface 56 and a rearward surface 58. The rearward surface of second panels 18 and 18' have a series of grooves 60 formed longitudinally in the upper half, and a series of corresponding elongated protrusions 62 formed on the lower half. In this way, when second panels 18 and 18' are clamped together by pivoting wings 12 and 12' about hinge 14, the corresponding protrusions 62 and 62' will align with grooves 60' and 60 to grip paper placed therebetween. It should be noted that grooves 60 and 60' and protrusions 62 and 62' are exaggerated in the drawings for clarity. In use, the protrusions need only be very minimal in order to provide sufficient frictional contact to maintain a paper between panels 18 and 18' without causing damage to the paper.

Figure 12:
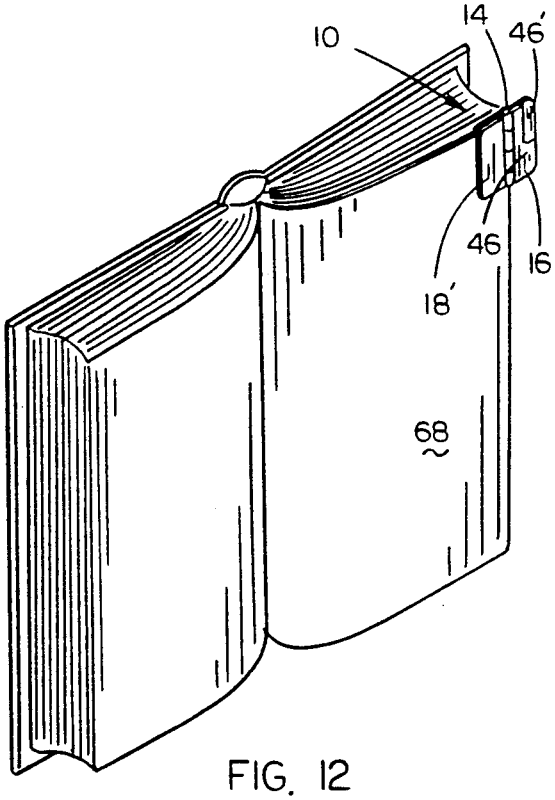
FIG. 12 is a perspective view of the invention attached to the pages of a book.
Figure 13:
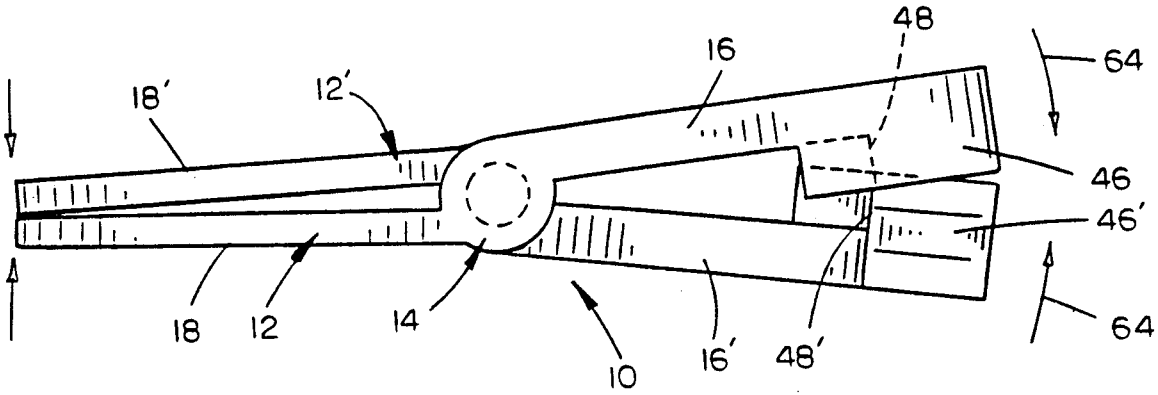
FIG. 13 is an end edge view of the invention in the process of being clamped close.
Figure 14:
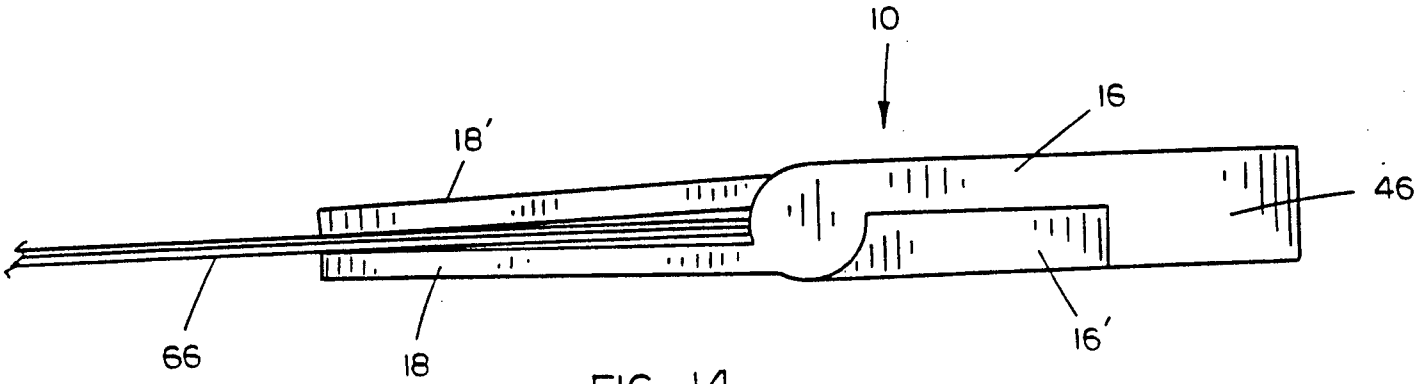
FIG. 14 is a view similar to FIG. 13 with the invention clamped in position on sheets of paper.

In use, second panels 18 and 18' form clamping panels, while first panels 16 and 16' form tab panels. As shown in FIG. 13, clamping panels 18 and 18' will contact one another before tab panels 16 and 16' are in parallel engagement, due to the two bends formed in clamping panels 18, as described in more detail hereinabove. Continued pressure on tab panels 16 and 16', as shown by arrows 64 will cause flanges 46 and 46' to lock together (as shown in FIGS. 10 and 11) to maintain a gripping pressure on clamp panels 18 and 18' and on sheets of paper 66 therebetween, as shown in FIG. 14. Preferably, index tab 10 is composed of a plastic material which is resiliently flexible such that the clamping pressure is provided by the bending of the clamping panels 18 and 18'. Index tab 10 may thereby be clamped to a book page 68, as shown in FIG. 12 with tab panels 16 projecting outwardly therefrom as an index tab. The space formed between tab panels 16 and 16' and between hinge 14 and shoulders 48 and 48' will retain a sheet of paper with written material for an index. For this reason, it is preferable that the plastic material for index tab 10 be transparent, or at least translucent.

Whereas the invention has been shown and described in connection with the preferred embodiment thereof, it will be understood that many modifications, substitutions, and additions may be made which are within the intended broad scope of the appended claims. There has therefore been shown and described an improved removable index tab which accomplishes at least all of the above stated objects.

I claim:

1. A reusable indexing tab, comprising:

first and second wing portions operably pivotally connected for movement between a clamped position and an unclamped position;

said first wing portion including:

a first generally planar panel having longitudinal inner and outer side edges, upper and lower edges and forward and rearward surfaces;

a first hinge portion mounted on a portion of said inner edge; and a second generally planar panel having longitudinal inner and outer edges, upper and lower edges and forward and rearward surfaces, mounted along a portion of its inner edge to said first hinge portion, to thereby connect said first and second panels;

a second wing portion including:

a first generally planar panel having longitudinal inner and outer side edges, upper and lower edges and forward and rearward surfaces;

a first hinge portion mounted on a portion of said inner edge; and a second generally planar panel having longitudinal inner and outer edges, upper and lower edges and forward and rearward surfaces, mounted along a portion of its inner edge to see first hinge portion, to thereby connect said first and second panels;

said first and second wing portions operably connected at said hinge portions for pivotal movement between said clamped position, with the rearward surface of the first wing first panel in abutting flush contact with the rearward surface of the second wing first panel and the forward surface of the first wing second panel in abutting flush contact with the forward surface of the second wing second panel, and the upper edge of the first wing first panel in contact with the lower edge of the second wing first panel and the lower edge of the first wing first panel in contact with the upper edge of the second wing first panel, and said unclamped position wherein said first panels are pivoted apart and said second panels are pivoted apart;

bias means producing a clamping force between said rearward surfaces of said first and second wing first panels when in the clamped position;

said bias means including:

said first and second wing portions being formed of a resilient flexible material; and said first panels of said first and second wing portions each having a bend therein such that said first panels are bent rearwardly towards one another when connected together, said bends located such that the bent portions of said first panels are forced into flat coplanar positions biased against said bends when said wing portions are moved to the clamped position, to produce the clamping force between the first panels; and means for selectively locking said wing portions in the clamped position.

2. The tab of claim 1, wherein said first panels of said first and second wing portions each include:

a bend transversely from inner side edge to outer side edge and located midway between the upper and lower edges to form an upper leg comprising a segment of each first panel from the transverse bend to the upper edge, and a lower leg comprising a segment of each first panel from said transverse bend to the lower edge; and each upper leg being bent rearwardly with respect to a plane associated with the lower leg such that the upper and lower legs of each said first panel will be forced to coplanar positions against a leg biasing force generated by said transverse bends when moved to the clamped position, to grip a sheet of paper between said first panels.

3. The tab of claim 2, wherein said first panels of said first and second wing portions are bent rearwardly along their longitudinal connections to said hinge portions such hat said first panel outer edges will be biased together to force the first panels into positions coplanar with their associated second panels against the bias of the longitudinal bends when in the clamped position, to grip a sheet of paper between said first panels.

4. The tab of claim 1, wherein said first panels of said first and second wing portions are bent rearwardly along their longitudinal connections to said hinge portions such that said first panel outer edges will be biased together to force the first panels into positions coplanar with their associated second panels against the bias of the longitudinal bends when in the clamped position, to grip a sheet of paper between said first panels.

5. The tab of claim 1, further comprising means on said first panel rearward surfaces for frictionally engaging a sheet of paper when in the clamped position.

6. The tab of claim 5 ,wherein said frictional engagement means includes:

ridges on an upper half of said first panels; and grooves on a lower half of said first panel of the first wing corresponding with the ridges on the first panel of the second wing to engage when in a clamped position.

7. A reusable indexing tab, comprising:

first and second wing portions operably pivotally connected to movement between a clamped positions and an unclamped position;

said first wing portion including:

a first generally planar panel having longitudinal inner and outer side edges, upper and lower edges and forward and rearward surfaces;

a first hinge portion mounted on a portion of said inner edge; and a second generally planar panel of transparent material having longitudinal inner and outer edges, upper and lower edges and forward and rearward surfaces, mounted along a portion of its inner edge to said first hinge portion, to thereby connect said first and second panels;

a second wing portion including:

a first generally planar panel having longitudinal inner and outer side edges, upper and lower edges and forward and rearward surfaces;

a first hinge portion mounted on a portion of said inner edge; and a second generally planar panel of transparent material having longitudinal inner and outer edges, upper and lower edges and forward and rearward surfaces, mounted along a portion of its inner edge to said first hinge portion, to thereby connect said first and second panels;

said first and second wing portions operably connected at said hinge portions for pivotal movement between said clamped position, with the rearward surface of the first wing first panel in abutting flush contact with the rearward surface of the second wing first panel and the forward surface of the first wing second panel in abutting flush contact with the forward surface of the second wing second panel, and the upper edge of the first wing first panel in contact with the lower edge of the second wing first panel and the lower edge of the first wing first panel in contact with the upper edge of the second wing first panel, and said unclamped position wherein said first panels are pivoted apart and said second panels are pivoted apart;

said second panels including portions thereon or receiving and holding a slip of paper between said second panels when in the clamped position, or displaying printed indicia on said slip of paper;

bias means producing a clamping force between said rearward surfaces of said first and second wing first panels when in the clamped position; and means for selectively locking said wing portions in the clamped position.

8. A reusable indexing tab, comprising:

first and second identical wing portions operably pivotally connected for movement between a clamped position and an unclamped position;

said first wing portion including:

a first generally planar panel having longitudinal inner and outer side edges, upper and lower edges and forward and rearward surfaces;

a first hinge portion mounted on a portion of said inner edge; and a second generally planar panel having longitudinal inner and outer edges, upper and lower edges and forward and rearward surfaces, mounted along a portion of its inner edge to said first hinge portion, to thereby connect said first and second panels;

a second wing portion including:

a first generally planar panel having longitudinal inner and outer side edges, upper and lower edges and forward and rearward surfaces;

a first hinge portion mounted on a portion of said inner edge; and a second generally planar panel having longitudinal inner and outer edges, upper and lower edges and forward and rearward surfaces, mounted along a portion of its inner edge to see first hinge portion, to thereby connect said first and second panels;

said first and second wing portions operably connected at said hinge portions for pivotal movement between said clamped position, with the rearward surface of the first wing first panel in abutting flush contact with the rearward surface of the second wing first panel and the forward surface of the first wing second panel in abutting flush contact with the forward surface of the second wing second panel, and the upper edge of the first wing first panel in contact with the lower edge of the second wing first panel and the lower edge of the first wing first panel in contact with the upper edge of the second wing first panel, and said unclamped position wherein said first panels are pivoted apart and said second panels are pivoted apart;

bias means producing a clamping force between said rearward surfaces of said first and second wing first panels when in the clamped position; and means or selectively locking said wing portions in the clamped position.

* * * * *